US005288166A

United States Patent [19]

Allen et al.

[11] Patent Number: 5,288,166

[45] Date of Patent: Feb. 22, 1994

[54] LASER OPERATED AUTOMATIC GRADE CONTROL SYSTEM FOR CONCRETE FINISHING

[75] Inventors: J. Dewayne Allen, Paragould, Ark.; Ralph Luebke, Memphis, Tenn.; Thomas J. Leyes, Oakville, Canada

[73] Assignee: Allen Engineering Corporation, Paragould, Ark.

[21] Appl. No.: 903,936

[22] Filed: Jun. 26, 1992

[51] Int. Cl.[5] ..... E01C 19/00

[52] U.S. Cl. ..... 404/84.1; 404/84.5; 404/114

[58] Field of Search ..... 404/84.1, 84.5, 114, 404/118

[56] References Cited

U.S. PATENT DOCUMENTS

| | | | |
|---|---|---|---|
| 3,113,494 | 12/1963 | Barnes | 404/114 |
| 3,118,353 | 1/1964 | Neil | 404/114 |
| 4,249,327 | 2/1981 | Allen | 404/114 |
| 4,371,330 | 2/1983 | Heffernan | 404/118 |
| 4,752,156 | 6/1988 | Owens | 404/118 |
| 4,978,246 | 12/1990 | Quenzi et al. | 404/84 |
| 5,190,396 | 3/1993 | Aoyagi et al. | 404/84.5 |

*Primary Examiner*—Mark Rosenbaum
*Assistant Examiner*—John M. Husar
*Attorney, Agent, or Firm*—Stephen D. Carver; J. L. Mahurin

[57] ABSTRACT

An automatic grading control device for finishing plastic concrete controls several different elongated, multi-section concrete finishing tools such as vibratory screeds or the like, with or without forms. Supporting skis facilitate sliding, winch driven movement of the device relative to the plastic concrete. Spaced apart and vertically upwardly extending towers are supported by the skis and disposed periodically along the length of the finishing tool. Each tower comprises a pair of elongated, spaced apart stanchions disposed on opposite sides of the tool that are braced with a rigid, adjustable upper strut. The strut extends between the stanchions and forms the top of the tower. Movable sleeves coaxially fitted to the stanchions are synchronized by rigid transverse bridges that extend between the sleeves above the tool. Hydraulic or pneumatic cylinders extending between the strut and the bridge raise and lower the tool thereby controlling level. The cylinders are controlled by a beacon laser and attendant sensors secured to the device. A control panel controls both the cylinders and winches. The winches move the device along the plastic concrete by spooling cables secured to a fixed point.

16 Claims, 6 Drawing Sheets

LASER OPERATED AUTOMATIC GRADE CONTROL SYSTEM FOR CONCRETE FINISHING

BACKGROUND OF THE INVENTION

This invention relates generally to concrete finishing devices that provide smooth, continuous concrete surfaces of a substantially uniform grade and finish. More particularly, our invention relates to laser controlled grade fixing devices for concrete finishing of the type classified in U.S. Class 404, subclasses 84, 114, 118 and/or 120.

As recognized by those skilled in the concrete finishing arts, after concrete is initially placed during construction, the upper surface must be appropriately finished to give it a smooth, homogeneous and correctly textured surface and appearance. A wide variety of finishing devices, including screeds, have long been in use throughout the industry for treating plastic concrete. Known prior art systems include "bull" floats, various forms of finishing boards, strike-offs, pans, plows, blades and the like. Bull floats essentially comprise a flat wooden board attached to a handle, much like a broom handle. These floats are intended to be manipulated by a single worker. Strike-offs contact rough, unfinished plastic concrete with a rigid leading edge to initially form and grade fresh concrete.

It is well known that vibration facilitates concrete finishing, and many vibrating systems have previously been proposed. Vibration during screeding helps to settle the concrete and eliminate air voids. Also, it helps to densify and compact the concrete during finishing. Vibrational screeding also draws out excess water thereby increasing the cured strength of the placed concrete. A fine layer of component cement and sand aggregate are raised to the surface by vibration along with the excess water. This slurry aids subsequent fine finishing. In general, vibration promotes the attainment of a uniform product. Often screeds extend between and rest upon the forms between which the plastic concrete is actually confined. Forms constrain the concrete until it is set, and provide a working support for the typical screed or finishing machine.

The selection of blade design for a particular machine is based upon a variety of factors, such as the characteristics of the concrete being laid. Variables relating to concrete finishing result from the selected type and percent of aggregate, sand, cement, epoxy, ad-mix, and water. Temperature, slab thickness, slump and placement method also vary the application procedure. Those skilled in the art will recognize that the selected finishing equipment must be appropriately mated to the job demands. Thus in screeding, for example, an optimum blade must be chosen based on the condition of the concrete. If high slump concrete is to be screeded, a floating pan would be ideal. For finishing drier concrete, a heavier twin-bladed screed might be more desirable. In all cases it is desirable to provide a means that automatically insures level finishing. While laser equipped screeding systems are known in the art, the expensive laser and hardware control system associated with such screeds is not easily adaptable for use with other common finishing mechanisms.

J. Dewayne Allen, one of the present co-inventors holds several patents in the art of concrete placement and finishing. One such is a prior art self-propelled "triangular truss" screed that rides upon the aforementioned forms, namely U.S. Pat. No. 4,349,328. Additionally, U.S. Pat. No. 4,798,494 discloses a floating vibratory screed intended to facilitate the finishing of concrete with or without forms. Finally, Allen prior U.S. Pat. Nos. 4,316,715; 4,363,618 and 4,375,351 and the various references cited and discussed therein are germane to the general technology discussed herein. All the above patents have been assigned to the same assignee as the present case.

U.S. Pat. Nos. 4,650,366 and 3,386,901 disclose screeds capable of formless, self-supporting or floating operation. The latter patent speaks to a relatively heavy triangular truss screed adapted to be operated by two workmen without the use of forms. U.S. Pat. No. 4,650,366 discloses a light weight, portable vibrating screed including a central, extruded beam element. A floating screed manufactured by Les Placements Paro of Canada, although it is not necessarily prior art and is apparently unpatented, is believed relevant. It includes a floating pan that is physically offset from, and adjustably coupled to, a parallel and spaced-apart strike-off knife assembly.

U.S. Pat. No. 3,431,336 discloses a vibrating finishing screed adapted for use upon plastic concrete that apparently is capable of floating. U.S. Pat. No. 2,314,985 discloses a vibratory hand screed including a central, vibrated pan that is apparently adapted for use upon plastic concrete without support upon confining forms.

Another prior art floating screed of general relevance is disclosed in a video tape produced by the American Concrete Institute and The Portland Cement Association, entitled "Finishing Concrete Flatwork," that bears a Copyright date of 1984. Other prior art screeds, generally of the "form-riding" type, include those screeds disclosed in U.S. Pat. Nos. 4,340,351; 4,105,355; 2,651,980; 2,542,979; 3,095,789; 2,693,136; and 4,030,873.

Lasers are commonplace on the modern construction site. They are employed in surveying and general leveling operations. Fukukawa U.S. Pat. Nos. 4,861,189 and 4,854,769 disclose a system for paving inclined and/or curved surfaces. This system employs anchor vehicles and paving vehicles. The paving vehicles are secured to the anchor vehicles by wires. The connections of the wires to the anchor vehicles are controlled by means of a laser sensing device. Microcomputers control the shape of the paving devices to create compound and complex curves in paved surfaces. Two devices employing a vehicle with a boom terminating in a screed are disclosed in Hansen U.S. Pat. No. 5,039,249 and Quenzi U.S. Pat. No. 4,930,935. Each of these patents relates to an anchor vehicle and a telescoping boom extending horizontally from the vehicle. The boom terminates in a screeding device that may also employ augers and vibrators. A second Quenzi U.S. Pat. No. 4,978,246 discloses an apparatus and method for controlling laser guided machines. This patent relates to an improvement to the above Quenzi patent.

Most relevant to the present invention is Owens U.S. Pat. No. 4,752,156. It discloses a manually operated laser guided portable screed. This invention is basically a screed with a pair of laser sensors mounted to it. Operators manually adjust the height of the screed as they draw it across placed concrete in response to a signal from the laser sensor. All of the above mentioned devices use a stationary laser beacon which projects a plan of laser light in a 360 degree plane.

However, none of the prior art devices known to us provides a satisfactorily efficient system for controlling the finished elevation of a concrete surface without the use of forms or heavy machinery. No prior art device provides for finishing plastic concrete to a uniform elevation or at a uniform angle of grade employing conventional portable, formless, floating screeds. Such screeds can be conveniently and concurrently used for vibrating, striking-off, and float finishing. Particularly, no device disclosed by the prior art is suitable for use within a building or in other confined areas. Additionally, prior art devices are restricted to a designed use and are not adaptable to a variety of uses. The prior art devices cannot be combined to work in a gang configuration. Neither can the prior art devices be reduced to a limited number of components to facilitate use in tight spaces or to increase the efficiency of available resources. In the conventional, combination, floating, vibratory screed, the relationship between the buoyancy of the pan, the plastic concrete's resultant surface tension, and the overall center of gravity of the apparatus are harmoniously balanced. The prior art devices also fail to take advantage of these balanced characteristics.

SUMMARY OF THE INVENTION

We have developed a Laser Operated Automatic Grade Control System for automatically controlling the elevation of concrete finishing tools. The device provides precise laser guidance to the selected finishing tool, such as a screed or the like, whether the area to be finished is great or small. The device is capable of being deployed within a limited area, and it may be deployed without forms. The disclosed device is capable of operating a floating screed without detracting from the screed's inherent ability to balance the screed pan's buoyancy with the surface tension of the concrete. To accomplish this the device is designed to maintain the finishing tool's inherent center of gravity.

Several frame elements of the selected finishing tool can be ganged together to form the desired length. The combined device slides on a component ski system resting below the surface of the concrete. Spaced apart control towers extending upward from the ski systems support the finishing tool. The relative elevation of a remote laser beacon is detected by the device. In answer, the device adjusts the elevation of the tool in response to the laser to produce a smooth finish that is level or at a uniform grade.

A ski system supports the device on the subgrade or rebar. The support towers project upwardly from the skis, and as the skis skid along during finishing, the tool is leveled and controlled. Each tower comprises a pair of vertically oriented stanchions preferably linked together by an upper strut that forms the tower top. A bridge assembly is movably coupled to the stanchions and slidable with respect thereto. The bridge assembly comprises a slidable sleeve mounted coaxially for slidable movement along each stanchion. The sleeves are synchronized by a transverse bridge extending between them above the concrete surface. The bridge is coupled at its bottom to the finishing tool and at its top to an adjustable hydraulic cylinder extending downwardly from the strut. The cylinder extending between the tower top strut and the bridge assembly thus levels the tool.

A remote laser (or alternatively an optical beacon or the like) provides sighting reference signals. The skis slide along the sub-grade or on rebar laid down earlier. The laser sensor is adjustably mounted on a mast. In turn, the mast is secured to a flange extending from the bridge assembly. The sensor is connected by a cable to the control panel.

The control panel is preferably shock mounted to the upper cross member of the ski frame. The control panel interprets the sensor outputs to control the extension and retraction of the hydraulic cylinders to maintain the screed at the proper elevation. Conventional winches move the device along the plastic concrete to be surfaced. They are preferably mounted to flanges on the bridge assembly spool cables that are secured to a fixed point.

As mentioned above, a plurality of spaced apart towers can control a single elongated finishing tool. The beacon is established at a fixed elevation or angle of inclination. The towers are adjusted to initially obtain the desired tool elevation, and the proper hydraulic cylinder displacement. The sensor must be adjusted on the mast to obtain initial alignment of the laser and the sensor. As the device moves over the surface of the concrete, the sensors output the elevation of the beacon to the control panel. The hydraulic cylinders are controlled by the output of the control panel thereby, establishing the desired tool elevation.

Thus a primary object of the present invention is to provide a portable laser controlled grade fixing device that can be used with a variety of concrete finishing mechanisms such as roller tube finishers, strike-offs, screeds, trowels, plows, pavers with shaped blades and the like to facilitate the finishing of plastic concrete.

A related object is to provide an automatic grade control device of the character described for controlling a variety of differently configured screeds, including screeds that have tandem strike-offs combined with their pans, pan type blades, bull float tail pieces, and blades with concrete distributing augers.

Another object is to provide an automatic grade control system that is capable of functioning in response to a plurality of conventional reference signal devices such as lasers, sonic or acoustic devices, stringline configurations, optical, and microwave devices.

A still further object is to facilitate the formless placement of slabs on grades.

Another object is to simplify the placement of rebar.

A more particular object of the present invention is to provide a portable laser controlled grade fixing device and method for automated use of a self-floating vibrating screed for striking off, float finishing, and vibrating plastic concrete without forms in a single pass.

A related object of the present invention is to provide a mechanism to manipulate a floating vibrating screed without the use of external leveling systems such as winches, cranes or the like.

A related object is to provide a leveling system of the character described that can be easily used with vibrating screeds comprising rotating shaft eccentrics, electric vibrators, or pneumatic vibrators.

A still further object is to provide a leveling system that can be used with pavers.

Another fundamental object of the present invention is to provide grade fixing device of the character described which may mount screeds of various widths and lengths.

Still another basic object is to reduce labor costs. It is a feature of this invention that two to three days of crew time on a typical 100,000 sq. ft. slab finishing job on a grade can be saved.

A related object is to provide a device suitable for use within a building or in other relatively confined spaces.

Yet another related object of the disclosure is to relate a method to gang a varied number of the disclosed devices to establish the requisite control of a screed to accomplish a given concrete finishing task.

Yet another primary object of the present invention is to provide device to facilitate the use of a screed that may be used in finishing plastic concrete without the use of forms.

A still further object of the present invention is to provide a grade fixing device that uniformly contacts the plastic concrete surface.

Another object is to provide a device of the character described adapted to be easily balanced and self-supporting.

A similar object of the present invention is to provide or establish a grade on a wet screeded runway.

Yet another object of the present invention is to ease the use of a screed (or other concrete finishing tools) with relatively high slump or low slump concrete.

Another object is to provide a device to avoid slewing of a screed during float finishing of concrete.

Another object of the present invention is to facilitate the finishing of a great square footage of plastic concrete with a minimum of personnel, and with minimal repetitive operations.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and are to be construed in conjunction therewith, and in which like reference numerals have been employed throughout in the various views wherever possible.

DETAILED DESCRIPTION

Figure 1:
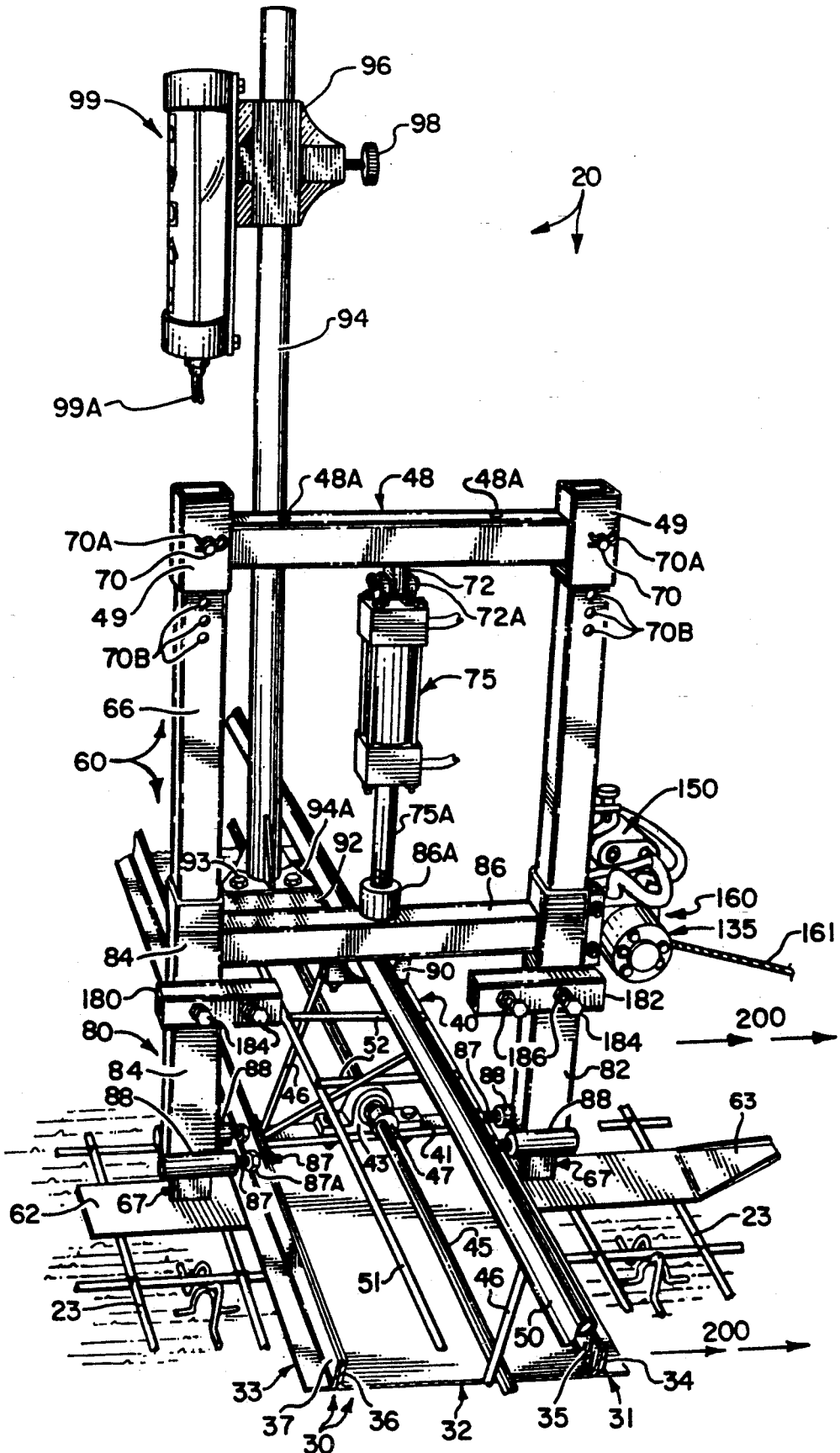
FIG. 1 is a fragmentary, perspective view of the best mode of our Laser Operated Automatic Grade Control System for Concrete Finishing.
Figure 5:
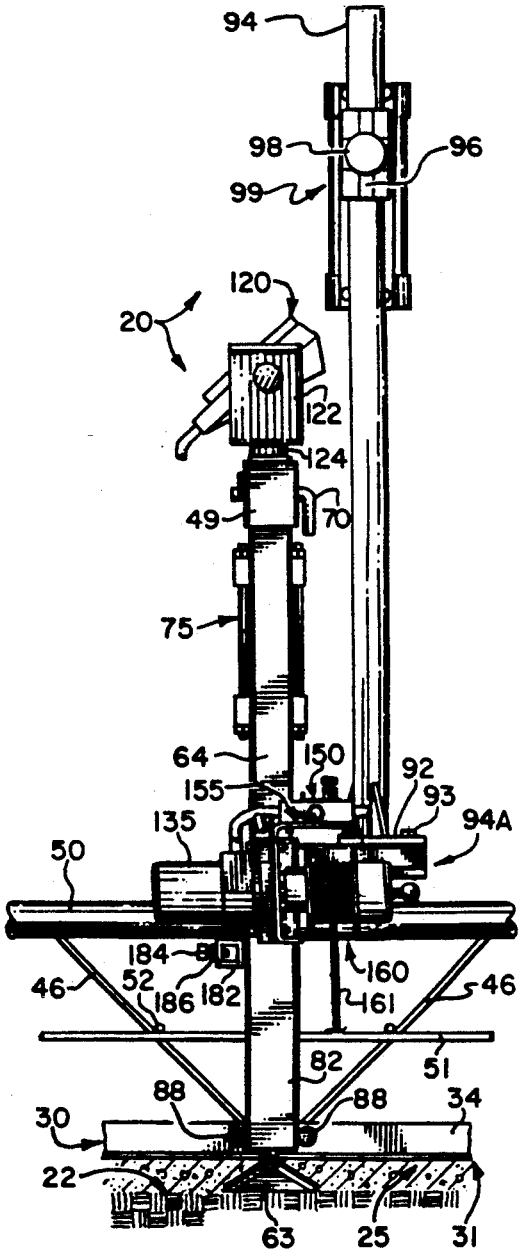
FIG. 5 is a front elevational view taken generally along line 5—5 of FIG. 3.

Turning now to the drawings, the preferred embodiment of our Laser Operated Automatic Grade Control System for Concrete Finishing is broadly designated by the reference numeral 20. Device 20 is adapted to finish concrete 25 by passing an elongated concrete finishing mechanism such as a vibratory screed 30 over freshly placed, plastic concrete 25. The device rides on the sub-grade 22 (FIGS. 5, 9) or preinstalled rebar 23, skidding along in the direction indicated by arrows 200. The elongated concrete finishing mechanism 30 is operationally suspended between two or more spaced apart tower assemblies 60 (FIG. 1). The tower assemblies 60 are mounted upon skis for skidding movement. Therefore, as the finishing mechanism 20 moves through and over the plastic concrete 25, it finishes or treats the concrete 25 smoothly, maintaining a desired elevation with little variation.

The illustrated concrete finishing mechanism is a screed, but a strike off, a float, or other form of bladed finishing device may be used. As will be recognized by those skilled in the art, such finishing mechanisms are assembled from several sections at the job site to provide the desired length. It is preferred that multiple towers 60 are employed in conjunction with our grading system. The number depends upon application length. The illustrated screed is a modular unit comprising a striking blade 31, a pan float 32 and a bull float 33. The blade 31 is intended to initially engage the concrete 25 for initial leveling or "striking-off." It is secured to the pan float 32 by a flange 34 that extends upward from the pan's trailing edge. A similar flange 35 extends upward from the blade's leading edge. The pan float 32, in turn, is secured to the bull float 33 by flanges 36 and 37 respectively. The float 33 is employed on the trailing edge of the screed 30 for finishing.

Although screeds and finishing tools of varying cross sections may be employed, screed 30 has an integral triangular-truss frame 40. A frame member 41 extending transversely across the screed is secured to upwardly projecting flanges 34–37 of the screed blade 31, pan 32, and bull float 33. A bearing housing 43 mounted on the frame member 41 houses a drive shaft 45. The drive shaft 45 is equipped with weighted eccentrics 47 on either side of the bearing housing 43. When the shaft is vigorously rotated vibration is imparted to the screed 30 through the bearing housing 43 and frame member 41, to aid in the compaction and finishing of the plastic concrete 25. Alternatively, multiple spaced apart pneumatic or electric vibrators will work. The screed frame 40 further comprises trusses 46 angularly extending from the intersection of the frame member 41 and the flanges 34-37 to a frame apex pipe 50. Stringers 51 and 52 run generally parallel with and perpendicular to the apex pipe 50 and are secured to the trusses 46.

Figure 9:
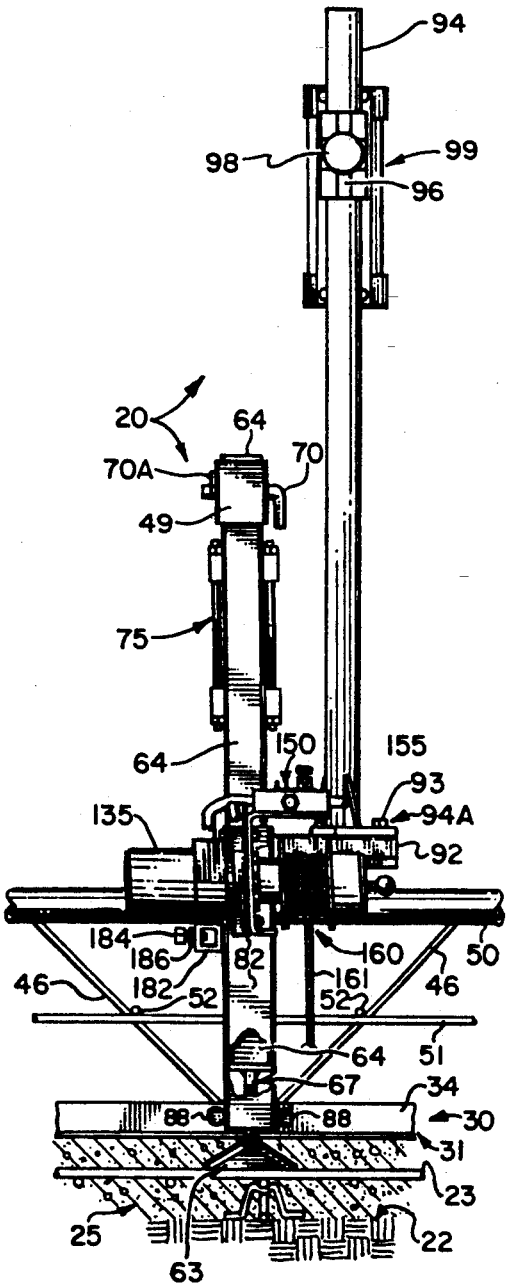
FIG. 9 is a front elevational view taken generally along line 9—9 of FIG. 7.

The concrete finishing tool 30 is supported at spaced apart intervals by the tower assemblies 60. The tower assemblies 60 generally comprises a ski 62 and a pair of stanchions extending upwardly from the ski 62, one forward stanchion 64 and one rear stanchion 66. An upper strut 48 extends between the stanchions 64 and 66 forming the top of the tower. The ski 62 rides on the sub-grade 22 or rebar 23 below the surface of the concrete 25. Each ski comprises an elongated, generally rectangular section of steel plate having an upturned forward end 63. The stanchions 64 and 66 are constructed of square steel tubing, and narrow at the lower end in a column 67 presenting a thin forward and rearward cross-section to the plastic concrete 25 (FIG. 9). This column 67 is affixed to the ski 62.

The tower top strut 48 has a transversely oriented, drilled sleeve 49 welded to it at each end. L-pins 70, secured by clips 70A, pass through holes drilled in the sleeves 49 and orifices 70B passing through the stanchions 64 and 66 at their upper extremes. The L-pins 70 can be placed through any of these orifices 70B, thereby allowing the height of strut 48 to be adjusted. An eye 72 extends downward from strut 48 to connect the hydraulic cylinder 75 to the tower assemblies 60 by pin 72A. The hydraulic cylinder extends downward to the tower bridge assembly 80.

The tower bridge assembly 80 operationally extends transversely from one stanchion 64 to the other stanchion 66. The bridge assembly 80 is coupled between the stanchions for vertical movements relative to the ground. It comprises a forward box tubing sleeve 82 and a rear box tubing sleeve 84, which are slidably, coaxially fitted to stanchions 64 and 66 respectively. The latter sleeves are welded to a transverse bridge 86, that extends between the upper extremes of the sleeves to synchronize the bridge assembly. The sleeves 82 and 84 slide over the stanchions 64 and 66.

A threaded boss 86A is secured to the dorsal surface of the bridge 86 at its approximate center. The ram 75A of the hydraulic cylinder 75 is screwed into the threaded boss 86A. A collar 90 secures the apex pipe 50 of the screed frame 40 to the underside of bridge 86. A tubular, threaded boss 88 is secured on each side of the lower extremes of the sleeves 82 and 84. These tubular bosses 88 define orifices extending generally perpendicular to the screed 30. Studs 87 pass from the bosses 88 through the screed flanges 34–37. Nuts 87A on each side of the flanges 34–37 secure the screed 30 to the bridge assembly 80.

A mounting flange 92 extends horizontally from the bridge 86. This flange 92 defines three threaded orifices. A mast 94 extends upward from the flange 92. Bolts 93 secure the gusseted base 94A of the mast 94 to the flange 92. An adjustment housing 96 mounts a three hundred-sixty degree laser sensor 99 to the mast 94. A knobbed screw 98 allows adjustment of the housing 96 and thereby the laser sensor 99. Each sensor 99 is connected by way of cable 99A to the control panel 120.

Figure 2:
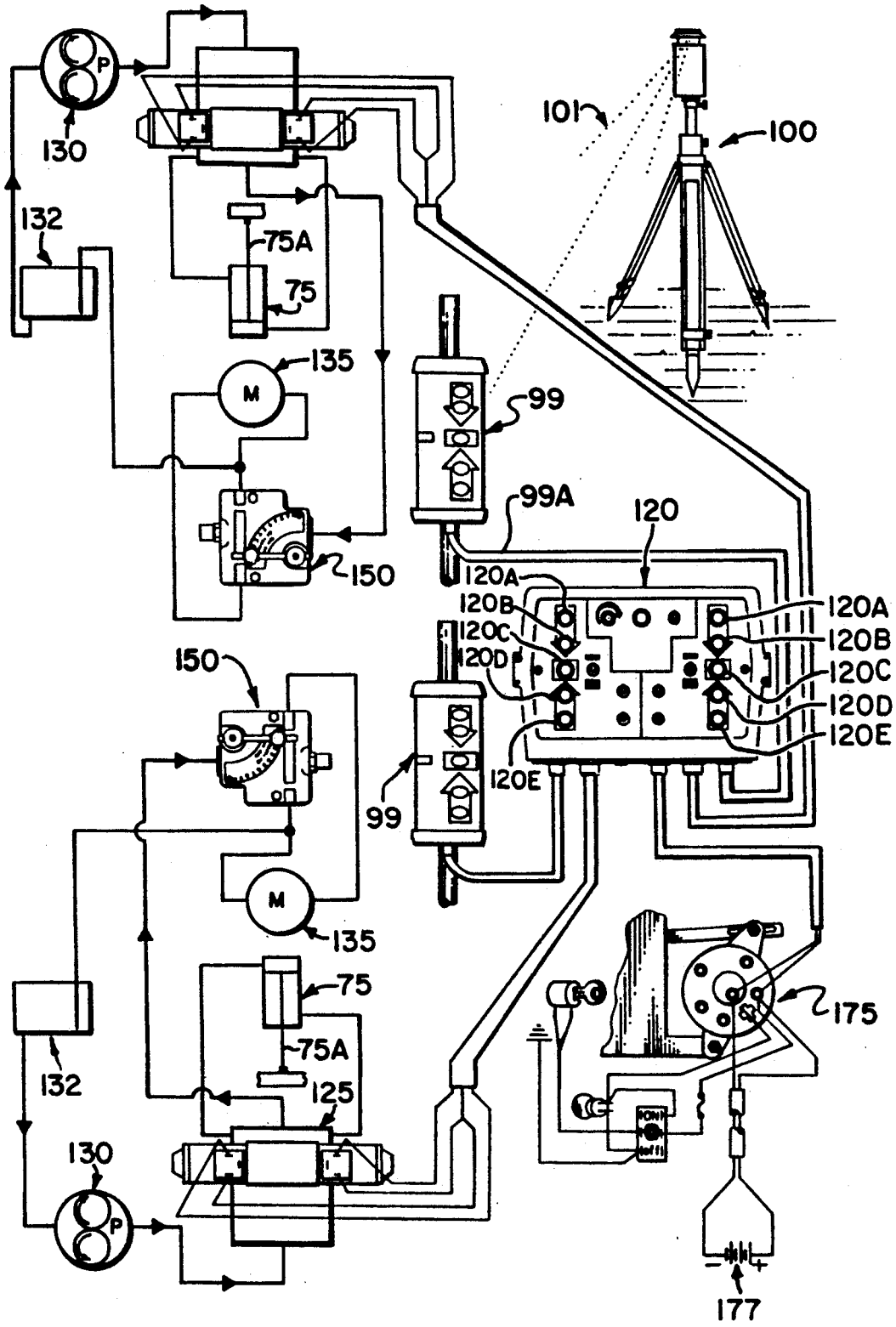
FIG. 2 is a combined pictorial and schematic drawing illustrating the control circuitry.
Figure 3:
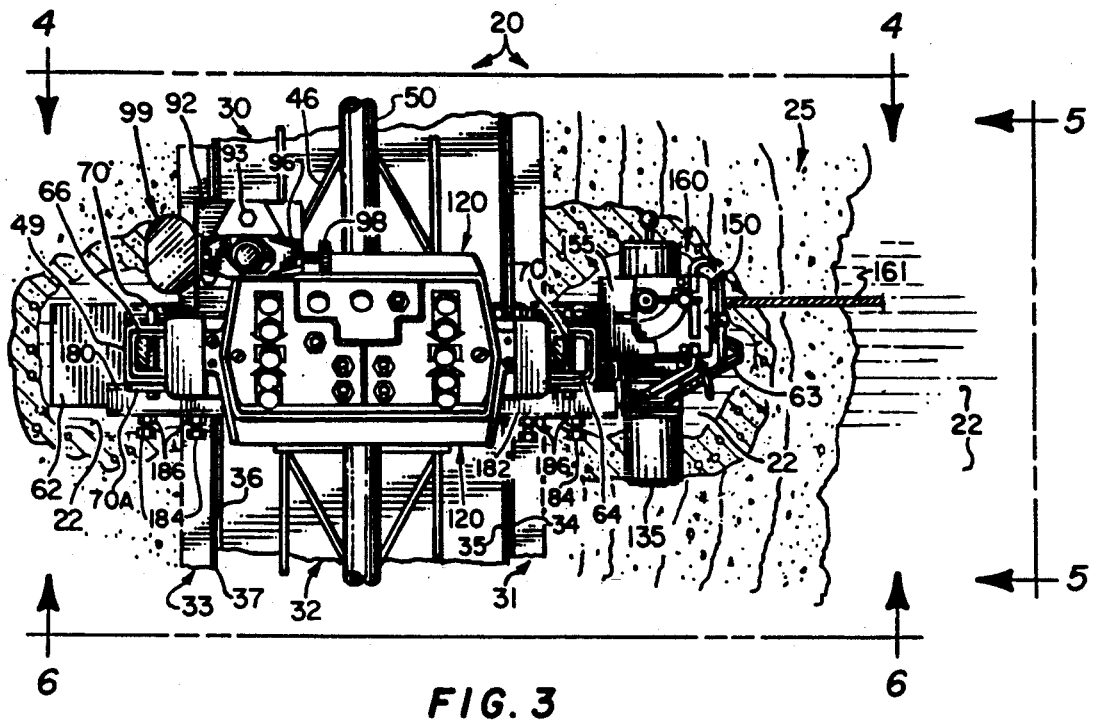
FIG. 3 is a top plan view of the device with the control panel installed for left-hand operation.
Figure 7:
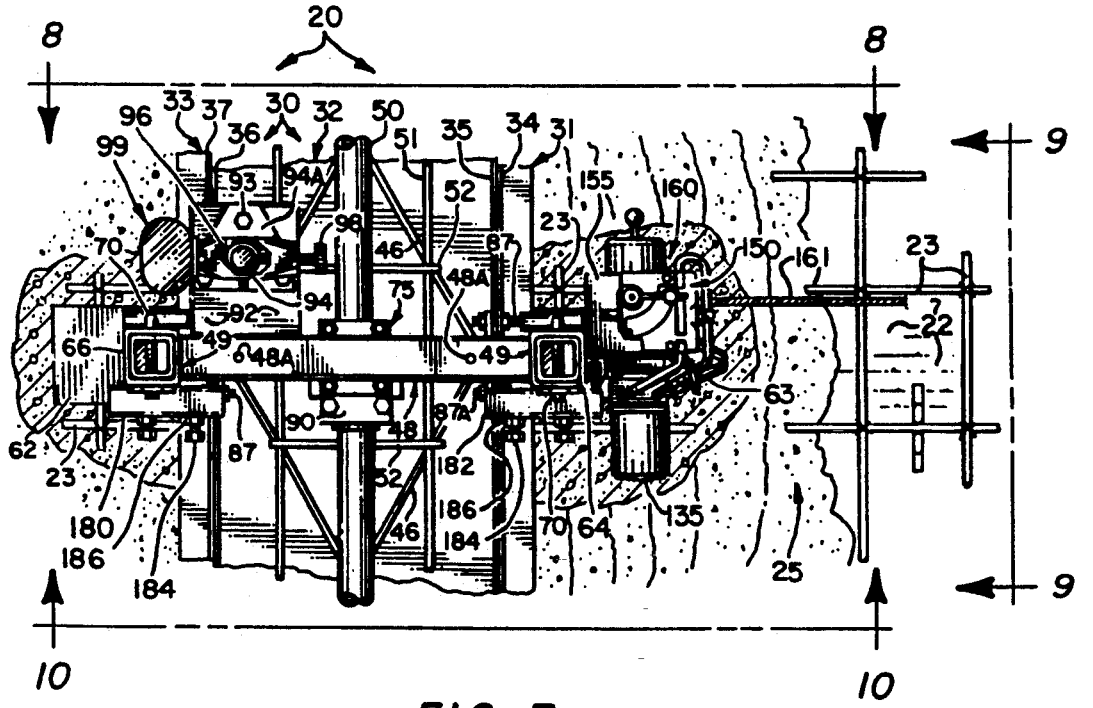
FIG. 7 is a top plan view of the device set up for right-hand operation with the control panel omitted for clarity.
Figure 8:
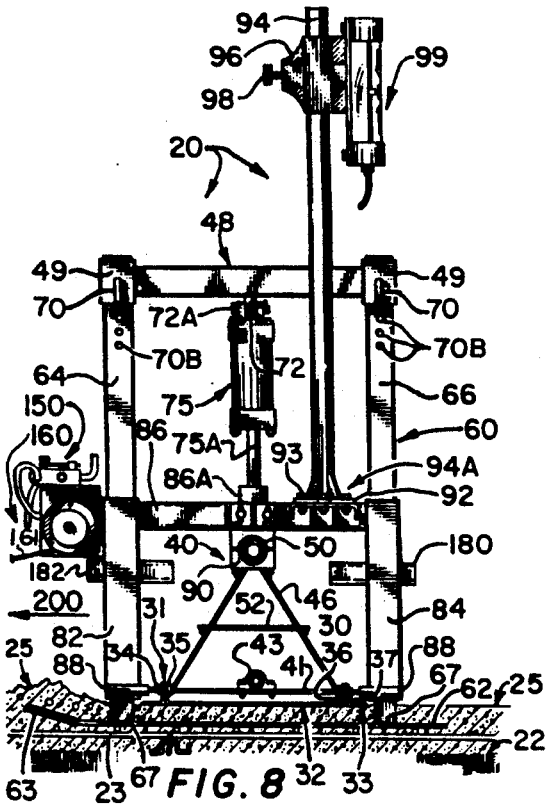
FIG. 8 is a side elevational view taken generally along line 8—8 of FIG. 7.
Figure 10:
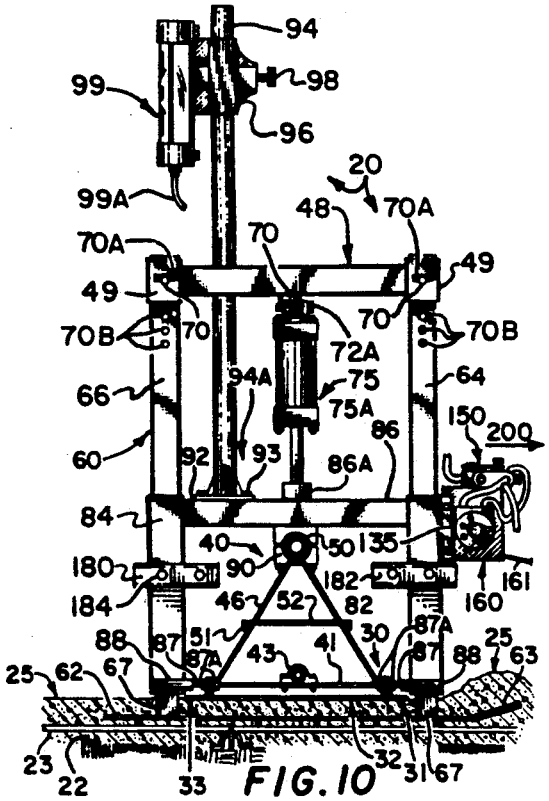
FIG. 10 is a side elevational view taken generally along line 10—10 of FIG. 7.
Figure 4:
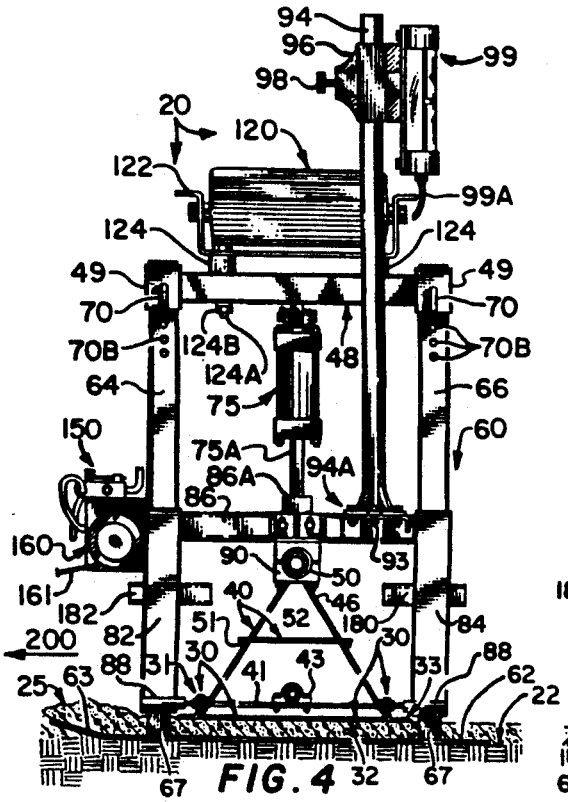
FIG. 4 is a side elevational view taken generally along line 4—4 of FIG. 3.
Figure 6:
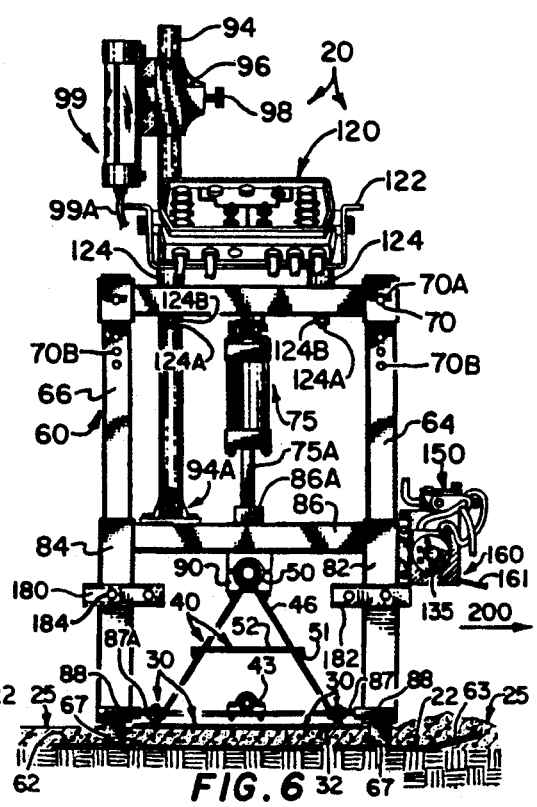
FIG. 6 is a side elevational view taken generally along line 6—6 of FIG. 3.

One control panel 120 directs the entire device, which preferably employs two or more tower assemblies 60, bridge assemblies 80 and attendant sensors 99. The control panel 120 is preferably a conventional dual automatic remote panel, typically Laser Alignment Inc., model number P/N 30231-01, Dual Automatic Control Panel. The control panel 120 is shock mounted to the strut 48 of one of the tower assemblies 60 (FIG. 4). A pair of holes 48A through strut 48 facilitates mounting the control panel 120 on any of the struts 48. Two rubber grommets 124 insulate the frame 122 of the control panel 120 from struts 48. Bolts 124A pass through the control panel frame 122, the grommets 124 and the strut holes 48A. The bolts 124A are secured by nuts 124B. Turing to FIG. 2, the control panel 120 translates the data received via cable 99A into one of five messages. Lights on the control panel 120 indicates the message for each attached sensor 99. The five messages and lights are high position 120A, high/near on grade position 120B, on grade position 120C, low/near on grade position 120D, or low position 120E. This data is output to the hydraulic cylinder control valve 125, which is interconnected to the speed control valve 150.

The hydraulic control valve 125 extends and retracts the hydraulic cylinder 75 as necessary to maintain the screed 30 at the proper elevation. Pressure is provided to the hydraulic control valve 125 by a pump 130 that draws from a tank 132. When the control valve 125 is not extending or retracting the cylinder the pressure on either side of the cylinder is equalized and is thereby transferred to the interconnected speed control valve 150. The speed control valve 150 operates a hydraulic motor 135 that drives the winch 160.

The winch 160 is preferably mounted to the forward bridge sleeve 82 by a flange 155. The winch 160 spools a cable 161 that is secured to a fixed remote point. The winch 160 moves the device 20 along the plastic concrete 25 to be surfaced or treated, pausing when a correction in the elevation is necessary due to the interconnection with the hydraulic control valve 125.

Power for the system is preferably provided by an alternator 175 driven by a small electric start engine. The alternator 175 is electrically connected to the control panel 120 and a battery 177.

In operation, the number of the above described tower assemblies 60 necessary to perform a task are used to control the screed 30. Generally at least two units are utilized. The device 20 is controlled by a laser beacon 100 of a conventional design such as Model LB-4 offered by Laser Alignment Inc. The beacon 100 is established at a fixed elevation. Furthermore, the beacon 100 can be established at an angle to facilitate finishing concrete 25 at a predetermined grade. The laser beacon 100 creates a plane of laser light 101 at a fixed elevation and angle which the sensors 99 of the device 20 will detect. The screed 30 must be adjusted to the desired initial elevation. Thereafter, it is necessary to adjust the sensor 99 upon the mast 94 to obtain initial alignment of the laser 100 and the sensor 99. Next, the elevation of screed 30 is fixed relative to the sensor 99. In other words, the screed is always the same distance below the sensor 99. During this set up process the adjustments available at bridge boss 86A and strut 48 via orifices 70B must be employed to ensure the hydraulic cylinder 75 has sufficient travel in both directions.

As the device 20 is towed with its attendant tool over the surface of the concrete 25 by the winch 160, the sensors 99 output the position of the planar laser 101 relative to the position of the sensor 99. The control panel 120 receives the sensor output and provides the necessary instructions to control the elevation of the tool via the hydraulic cylinder control valves 125 and thereby the hydraulic cylinder 75.

Figure 11:
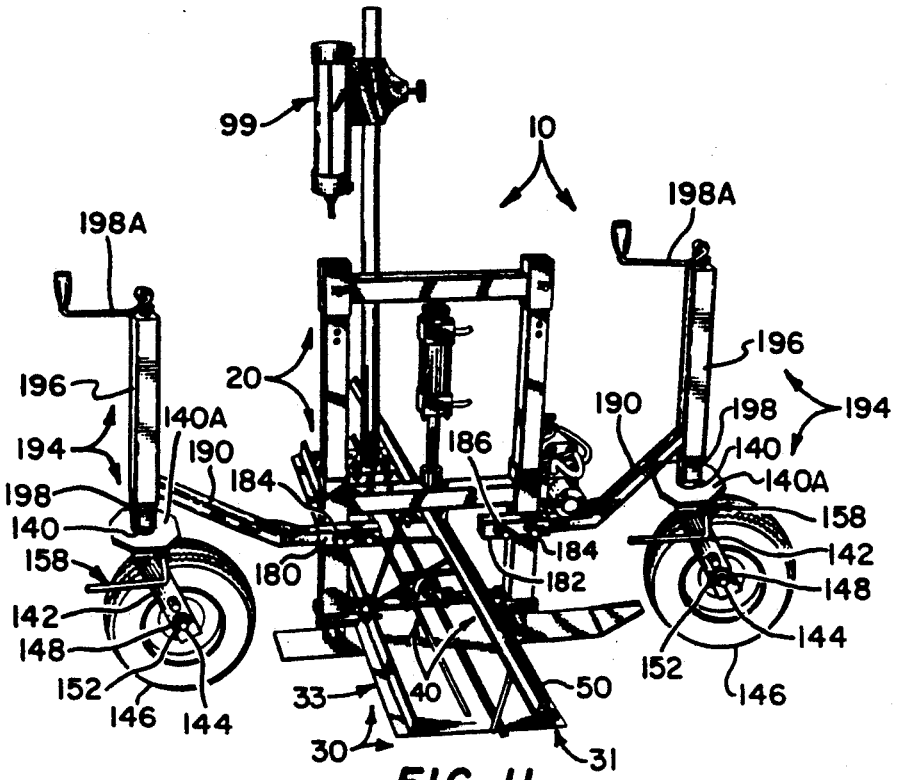
FIG. 11 is a fragmentary side perspective view of an optional dolly jack system used to move the apparatus intact on and off the work site; and, FIG. 12 is a fragmentary isometric view of an alternative dolly jack system used to transport the apparatus when it is desirable to separate the equipment into two halves.
Figure 12:
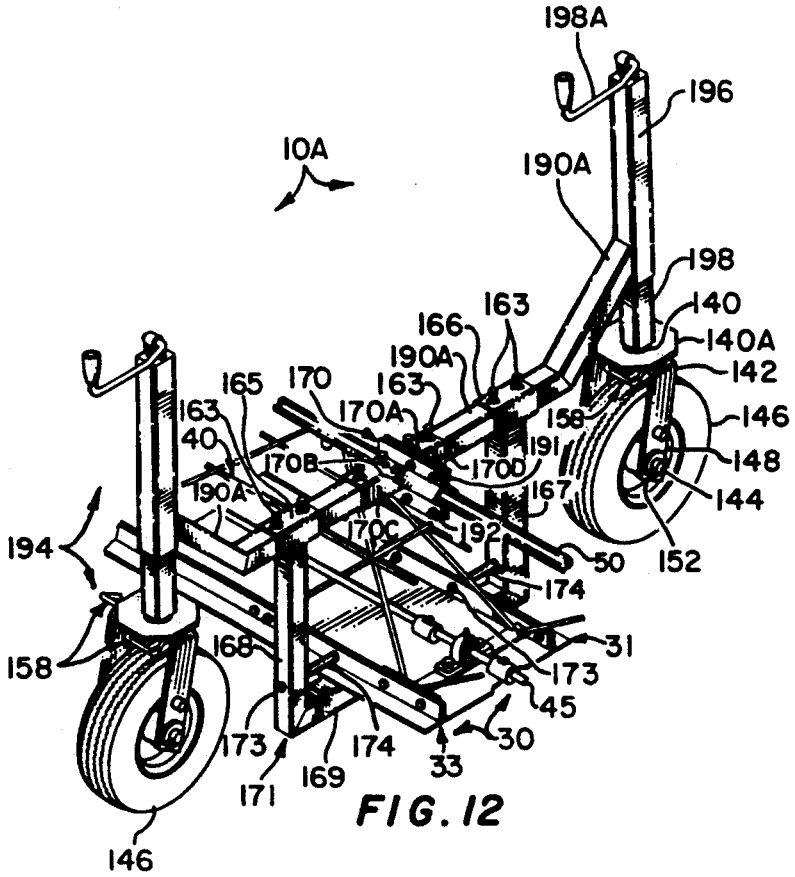

As seen in FIGS. 11 and 12, we have provided optional dolly wheel systems 10 and 10A for easily maneuvering the system 10 at the job site. With primary reference now directed to FIGS. 1 and 11, transverse dolly jack mountings 180 and 182 that are constructed of square steel tubing and are welded to sleeves 82 and 84. They are adapted to receive inserted frame members 190 projecting from the dolly wheels 194. Bolts 184 are threaded into nuts 186 that are welded on the face of the mountings 180, 182 concentrically about a clearance hole (not shown) in the mounting face, through which the bolts extend before contacting the inserted frame member 190 of the dolly jack 194.

Dolly jack 194 comprises a jack housing 196 that contains a sliding tube 198 affixed at the top to a rotatable screw actuator. A suitable jack, part number 610-184, is manufactured by the Hammerblow Corporation. The inserted frame member 190 is welded to housing 196. A handle 198A connects to the screw actuator and serves to raise or lower the sliding tube 198. The bottom of the tube 198 has a rounded end 140 that is slip fitted through an octagonal base plate 140A secured with a clip. The base plate 140A swivels about the rounded end. Welded to the bottom of the base plate 140A and made an integral part thereof is a forked bracket 142, the lower end of which is fitted with an axle 144 on which a wheel 146 revolves. The axle is secured to the forked bracket with washers 148 and clips 152 on the outside of each fork. A bent rod and sleeve combination 158 with the sleeves containing the rod and being welded to the top of the fork bracket 142 serves as a low cost and practical braking mechanism. The bent section of rod 158 serves as a wedge against the rubber tire on wheel 146. Deflection of the rubber will allow a properly positioned rod to go overcenter and lock against the tire.

The dolly jack configuration 10 shown in FIG. 11 can be used to move the equipment on and off the work site while remaining intact (i.e., as a whole unit without being partially disassembled). A separate jack 194 will be similarly mounted to each end. However, when it is desirable to separate or divide the apparatus into two halves, an additional configuration 10A as shown in FIG. 12 is employed. Specifically, when the equipment is halved, dolly wheel configuration 10 is used on one end of a half section, and configuration 10A (FIG. 12) is mounted on the opposite connecting end of that half section. The other half section would be configured in a like manner. Both would be moved to a new work area and the equipment sections would be joined after disassociating the dolly jacks 10 and 10A.

With reference to FIG. 12, the arrangement 10A is connected intermediate the finishing blade length, where there are no hydraulic level control mechanisms 20. The connecting bracket 170 for apex pipe 50 is comprised of two sleeve halves 170A and 170B fastened together with suitable mounting bolts 191 and nuts 192 to lift the mechanism. Set screws 163 hold the inserting frame members 190A of the dolly jacks 194 captive within sleeves 170C and 170D. Tool mounting bracket 171 comprises stanchions 167 and 168 projecting downwardly to support brace 169 that is placed in position beneath the blade to support it. Columns 167 and 168 are welded to horizontally oriented sleeves 165 and 166. The sleeves are equipped with set screws 163 for holding the inserted frame member 190A in a fixed, rigid position. The frame members 190A project through sleeves 165, 166 into sleeves 170C and 170D at the middle of the apparatus. Additionally, tubular bosses 174 being threaded at each end are held captive between screed 30 and an inner face of stanchions 168 and 167 and define orifices extending perpendicularly to the screed and stanchions 167 and 168. The bosses allow bolts 173 to pass through and secure the screed to mounting bracket 171.

Operation

Movement of the assembled screed on the job site is enhanced with the dolly wheels. The wheel outrigger slips into the end handle sockets, and then hand jacks elevate the screed to the travel height. If the screed is to be moved with a fork lift or crane, screed lift attachment brackets are available. Slip form pans can be fitted to the end handle and used as a grout containment with low slump concrete. The tower skis will usually support the screed to ride over subgrade or rebars. The skis provide stability as well as support. Skis would be selected if the concrete grout is to run to a wet joint interface or to a wall surface or against an isolation joint or key lock form. The concrete will run through the ski and connection parts. The finishing pass of the screed bullfloat blade will cover any trace of grout seams left by the passing ski supports.

Other paving jobs may require outboard wheels. The wheels are spaced outboard of the screed path and attached to the end handle. This system may be fitted with slip form face plates to contain the low slump concrete for formless pouring. Screeds can be fitted with powered self propelled track laying systems as a means of propulsion.

A well organized job and properly deployed equipment insures that the job will progress without disappointments. The screed or blade should first be assembled on a flat surface. If the assembly surface is not flat, the screed will follow the uneven surface. Blade straightness should be checked with the screed resting in its operating position on the subgrade. A stringline or wire line may be used to carefully check blade straightness, joint closure and twist of the screed. Any irregularities remaining in the screed blade profile will transfer to the finished concrete.

End handles may be installed in the normal manner. With automatic grade control end handles, one additional sequence of adjustment is required. With the screed in place on the subgrade, the subgrade must be measured to slab dimension. The hydraulic piston rod should be at one half stroke. If the screed blade is disposed properly on finish grade, the cylinder piston rod will be deployed at one half stroke. Adequate stroke adjustment will be available during automatic grade control finishing to accommodate blade travel while the skis are extended and/or retracted while negotiating the uneven subgrade. If height adjustments are required, screed end can be lifted under the blades with a hydraulic floor jack, and the pins from the towers can be repositioned for acceptable clearance. Optional screw jacks may be fitted to the end handles and if so equipped, height adjustment would be made with the screw jacks.

The beacon is deployed using a benchmark reference to establish finish grade. The cutting blade and bullfloat blade of each end and center must be level. Make any corrections necessary so as to produce a level surface. Automatic grade control functions are checked by first levering or tilting a ski. The screed should maintain finish grade level. The sensor (receiver) must be situated so that it can clearly see the beacon throughout the pour. Sensor height and position are easily positioned on the mast and fixed in place with appropriate screw adjustments.

With the engine and automatic grade control operating, the desired travel speed is set on the hydraulic winch, and a trial run of several feet is commenced to be sure that everything is functioning properly. With the screed at its starting position, the first batch of concrete is placed, and the screed rotating eccentric shaft is activated up to speed. The desired RPM will depend upon concrete slump and admix properties. With the concrete in place across the forward blade, the travel speed is adjusted to an appropriate rate and winch speed is adjusted to properly steer the screed and the cutting blade perpendicular to the travel direction.

To provide a good finish, the cutting blade should be fed a 1½ to 2½ inch surcharge. The characteristic of this extra material traveling before the cutting blade is comprised of sand slurry-cement grout. The aggregate is usually directed downwardly by the cutting blade, leaving this fine grout surcharge to travel before the advancing blade. This is true unless the slump is low; in this case, the surcharge may comprise some aggregate as well. The grout surcharge serves to fill any surface voids and provide a desirable surface to the finished concrete. As the screed progresses, grade, flatness and levelness should be periodically rechecked. Finish grades which incorporate crossfall must be monitored. Vibration as the screed passes over the area tends to shake the slab monolith level. If a crossfall is expected, then the high side may require some handwork to maintain the grade. Level slabs will not experience this problem. Low slump and dry mix ratios will affect screed blade selection and travel speed.

From the foregoing, it will be seen that this invention is one well adapted to obtain all the ends and objects herein set forth, together with other advantages that are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A laser operated automatic grade control device for finishing, surfacing or treating plastic concrete without forms, said device comprising:

an elongated concrete finishing mechanism adapted to be deployed in physical contact with said concrete for treating same, said finishing mechanism having a longitudinal axis;

at least two spaced apart, elongated skis oriented generally perpendicularly to said finishing mechanism for supporting the mechanism, said skis normally sliding below the surface of the concrete to be finished;

a pair of stanchions extending upwardly from each of said skis, one stanchion disposed adjacent each side of said finishing mechanism;

a slidable sleeve generally coaxially fitted about each of said stanchions;

means for coupling said sleeves to said finishing mechanism;

displacement means for raising and/or lowering said sleeves and thus said finishing mechanism;

laser means maintained at a fixed elevation for providing a reference level; and, control means for controlling said displacement means responsive to said laser means, thereby leveling the finishing mechanism to provide a level concrete surface.

2. The device as defined in claim 1 further comprising dolly wheel means for transporting said device between job site pours, and frame means for quick connecting said dolly wheel means to said device.

3. The device as defined in claim 2 further comprising an upper strut extending horizontally said ski and said finishing mechanism for linking said stanchions, said strut spaced apart from and parallel to said bridge.

4. The device as defined in claim 3 wherein said displacement means comprises a hydraulic cylinder suspended from said strut and extending to said bridge.

5. The device as defined in claim 4 wherein said bridge further comprises:

sensing means for determining alignment with said laser means; and, an offset mast to adjustably affix said sensing means aloft relative to said finishing mechanism.

6. The device as defined in claim 4 wherein said finishing mechanism is a screed comprising:

elongated, buoyant pan means for floating upon said plastic concrete;

blade means for cutting, striking off and leveling rough concrete rigidly associated with said pan means; and, vibrator means for vibrating said screed.

7. The device as defined in claim 4 further comprising motive means for moving said device along and through said plastic concrete upon said skis.

8. The device as defined in claim 7 wherein said motive means comprises a winch for spooling cable, said cable secured to a remote point, and said winch affixed to said bridge.

9. The device as defined in claim 1 further comprising an elongated bridge extending horizontally over said ski and said finishing mechanism between said sleeves, and means for coupling said displacement means to said bridge.

10. An automatic grade control device for finishing, surfacing or treating plastic concrete with or without the use of forms, said device comprising:

finishing means adapted to be deployed in physical contact with said concrete for treating same and oriented generally transversely with respect to the direction of travel of said device, said finishing means having a longitudinal axis;

ski means normally sliding below the surface of the concrete to be finished upon the subgrade or rebar for supporting the device;

tower means oriented generally perpendicularly to said finishing means and said ski means for supporting said finishing means, said tower means comprising:

a pair of stanchions extending upwardly from said ski means, one stanchion disposed adjacent each side of said finishing mechanism;

a slidable sleeve generally coaxially fitted about each of said stanchions;

bridge means extending horizontally over said ski and said finishing mechanism between said sleeves for synchronizing said tower means means for coupling said bridge means to said finishing mechanism; and, displacement means coupled to said bridge means for raising and/or lowering said bridge means and thus said finishing mechanism;

laser means maintained at a fixed elevation spaced out of the way of said grade control device for supplying a reference signal; and, means for controlling said displacement means responsive to said laser means, thereby leveling the finishing mechanism relative to the plane of said concrete.

11. The device as defined in claim 10 further comprising dolly wheel means for transporting said device between job site pours, and means for quick connecting said dolly wheel means to said device.

12. The device as defined in claim 11 further comprising an upper strut extending between said stanchions above and generally parallel to said bridge.

13. The device as defined in claim 12 wherein said displacement means comprises a hydraulic cylinder suspended from said strut and extending to said bridge.

14. The device as defined in claim 11 wherein said bridge further comprises:

sensing means for determining alignment with said laser; and, an offset mast to adjustably affix said sensing means aloft relative to said finishing mechanism.

15. The device as defined in claim 11 including winch means for moving said device by winding in cable secured to a remote point, said winch means affixed to said tower means.

16. The device as defined in claim 11 wherein said finishing mechanism is a screed comprising:

elongated, buoyant pan means for floating upon said plastic concrete;

blade means for cutting, striking off and leveling rough concrete rigidly associated with said pan means; and, vibrator means for vibrating said screed.

* * * * *